US005730513A

United States Patent [19]

Lemon et al.

[11] Patent Number: 5,730,513

[45] Date of Patent: Mar. 24, 1998

[54] HAIR APPLIANCE STORAGE CABINET

[76] Inventors: Dorothy Mae Lemon; Eddie L. Lemon, both of 3030 Cottonwood Dr., Atlanta, Ga. 30316

[21] Appl. No.: 799,000

[22] Filed: Feb. 7, 1997

[51] Int. Cl.[6] ..... A47B 81/00

[52] U.S. Cl. ..... 312/238; 312/324; 211/87; 248/314

[58] Field of Search ..... 312/238, 32 A; 211/87, 70.6; 248/304, 314, 309.1

[56] References Cited

U.S. PATENT DOCUMENTS

| | | | |
|---|---|---|---|
| 204,956 | 6/1878 | Doyle | 312/238 |
| 838,567 | 12/1906 | Nolen | 312/238 |
| 1,090,734 | 3/1914 | Mark | 312/238 X |
| 1,188,975 | 6/1916 | Montgomery | 312/238 X |
| 1,193,867 | 8/1916 | Buckley | 312/238 |
| 1,597,834 | 8/1926 | Scudder | 312/238 X |
| 2,368,284 | 1/1945 | Bullard | 312/238 |
| 2,368,285 | 1/1945 | Bullard | 312/238 |
| 2,605,159 | 7/1952 | Horn | 312/238 X |
| 4,712,313 | 12/1987 | Gettleman | 248/314 X |
| 4,819,800 | 4/1989 | Wilson | 211/70.6 X |
| 4,973,019 | 11/1990 | Baird et al. | 248/314 |
| 5,029,792 | 7/1991 | Desjardins | 248/309.1 |
| 5,485,931 | 1/1996 | Barr, Jr. | 211/87 X |

FOREIGN PATENT DOCUMENTS

| | | | |
|---|---|---|---|
| 405103707 | 4/1993 | Japan | 312/238 |
| 367402 | 3/1927 | United Kingdom | 312/238 |
| 353312 | 7/1931 | United Kingdom | 312/238 |
| 608307 | 9/1948 | United Kingdom | 312/238 |

*Primary Examiner*—James R. Brittain
*Assistant Examiner*—Hanh V. Tran

[57] ABSTRACT

A hair appliance storage cabinet including a housing that has a pair of upper side walls, a top wall and a bottom wall. The pair of upper side walls each have a first long end edge that is attached and a second long end edge. The pair of upper side walls each have a first short end edge and a second short end edge. The top wall is attached to each of the first short end edges and the bottom wall being attached to each of the second short end edges. The pair of upper side walls each have an interior surface. One of the upper side walls has a plurality of J-hook members coupled to the interior surface. One other of the upper side walls has a plurality of storage tubes coupled to the interior surface. Lastly, a supporting base has a pair of lower side walls and a generally rectangular front panel. The pair of lower side walls are attached to the bottom wall of the housing for supporting the housing above a receiving surface.

1 Claim, 3 Drawing Sheets

HAIR APPLIANCE STORAGE CABINET

BACKGROUND OF THE INVENTION

1. Field of the Invention

The present invention relates to a hair appliance storage cabinet and more particularly pertains to providing a storage unit that is designed to house multiple electrical hair appliances, those appliances being curling irons and blow dryers.

2. Description of the Prior Art

The use of a cabinet for hair utensils is known in the prior art. More specifically, cabinets for hair utensils heretofore devised and utilized for the purpose of storing the hair utensils are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,370,452 to Baer discloses a cabinet for hair salon utensils. U.S. Pat. No. 4,728,161 to Murphy discloses a corner cabinet. U.S. Pat. No. Des. 347,538 to Fleischer discloses a curling iron and hair dryer holder. U.S. Pat. No. 5,152,592 to Krayer discloses a corner cabinet. U.S. Pat. No. 4,966,424 to Schneider discloses cabinet construction. Lastly, U.S. Pat. No. 4,400,044 to Yoshiyuki discloses a modular cabinet system.

While these devices fulfill their respective, particular objectives and requirements, the aforementioned patents do not describe hair appliance storage cabinet that allows a plurality of curling irons and blow dryers to be housed within the same unit and held in an upright position along the walls of the housing and enclosed therein when not in use.

In this respect, the hair appliance storage cabinet according to the present invention substantially departs from the conventional concepts and designs of the prior art, and in doing so provides an apparatus primarily developed for the purpose of providing a storage unit that is designed to house multiple electrical hair appliances, those appliances being curling irons and blow dryers.

Therefore, it can be appreciated that there exists a continuing need for a new and improved hair appliance storage cabinet which can be used for providing a storage unit that is designed to house multiple electrical hair appliances, those appliances being curling irons and blow dryers. In this regard, the present invention substantially fulfills this need.

SUMMARY OF THE INVENTION

In view of the foregoing disadvantages inherent in the known types of cabinets for hair utensils now present in the prior art, the present invention provides an improved hair appliance storage cabinet. As such, the general purpose of the present invention, which will be described subsequently in greater detail, is to provide a new and improved hair appliance storage cabinet and method which has all the advantages of the prior art and none of the disadvantages.

To attain this, the present invention essentially comprises a housing that has a triangular form with a pair of upper side walls, a top wall and a bottom wall. The pair of upper side walls each have a first long end edge and a second long end edge. The first long end edge of each of the pair of upper side walls is fixedly attached, and forms a ninety degree angle therebetween. The pair of upper side walls each have a first short end edge and a second short end edge. The top wall is fixedly attached to each of the first short end edges when the pair of upper side walls is attached. The bottom wall is fixedly attached to each of the second short end edges when the pair of upper side walls are attached. A supporting base having a triangular form is provided. The supporting base has a pair of lower side walls and a generally rectangular front panel. The pair of lower side walls are fixedly attached to the bottom wall of the housing for supporting the housing above a receiving surface. The supporting base, with the housing positioned thereon, is positionable within a corner of a building. Also, the pair of upper side walls each have an interior surface that is accessible from exterior the housing, when the housing is seated on the supporting base. One of the upper side walls has a plurality of J-hook members that are coupled to the interior surface. Each J-hook member is capable of having a blow dryer hung therefrom. Another of the upper side walls has a plurality of storage tubes coupled to the interior surface. Each storage tube is capable of receiving a portion of a curling iron therein for supporting the curling iron. Lastly, a pair of generally rectangular door members are included. Each door member has a handle. One of the door members is hingedly coupled to the second long end edge of the upper side walls. Another of the door members is hingedly coupled to the second long end edge of another of the upper side walls. The pair of door members are coupled the pair of upper side walls for selective opening and closing to allow access to the curling iron and blow dryer within the housing.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hair appliance storage cabinet which has all of the advantages of the prior art cabinets for hair utensils and none of the disadvantages.

It is another object of the present invention to provide a new and improved hair appliance storage cabinet which may be easily and efficiently manufactured and marketed.

It is further object of the present invention to provide a new and improved hair appliance storage cabinet which is of durable and reliable constructions.

An even further object of the present invention is to provide a new and improved hair appliance storage cabinet which is susceptible of a low cost of manufacture with regard to both materials and labor, and which accordingly is then susceptible of low prices of sale to the consuming public, thereby making such hair appliance storage cabinet economically available to the buying public.

Even still another object of the present invention is to provide a hair appliance storage cabinet for providing a storage unit that is designed to house multiple electrical hair appliances, those appliances being curling irons and blow dryers.

Lastly, it is an object of the present invention to provide a new and improved hair appliance storage cabinet including a housing that has a pair of upper side walls, a top wall and a bottom wall. The pair of upper side walls each have a first long end edge that is attached and a second long end edge. The pair of upper side walls each have a first short end edge and a second short end edge. The top wall is attached to each of the first short end edges and the bottom wall being attached to each of the second short end edges. The pair of upper side walls each have an interior surface. One of the upper side walls has a plurality of J-hook members coupled to the interior surface. One other of the upper side walls has a plurality of storage tubes coupled to the interior surface. Lastly, a supporting base has a pair of lower side walls and a generally rectangular front panel. The pair of lower side walls are attached to the bottom wall of the housing for supporting the housing above a receiving surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
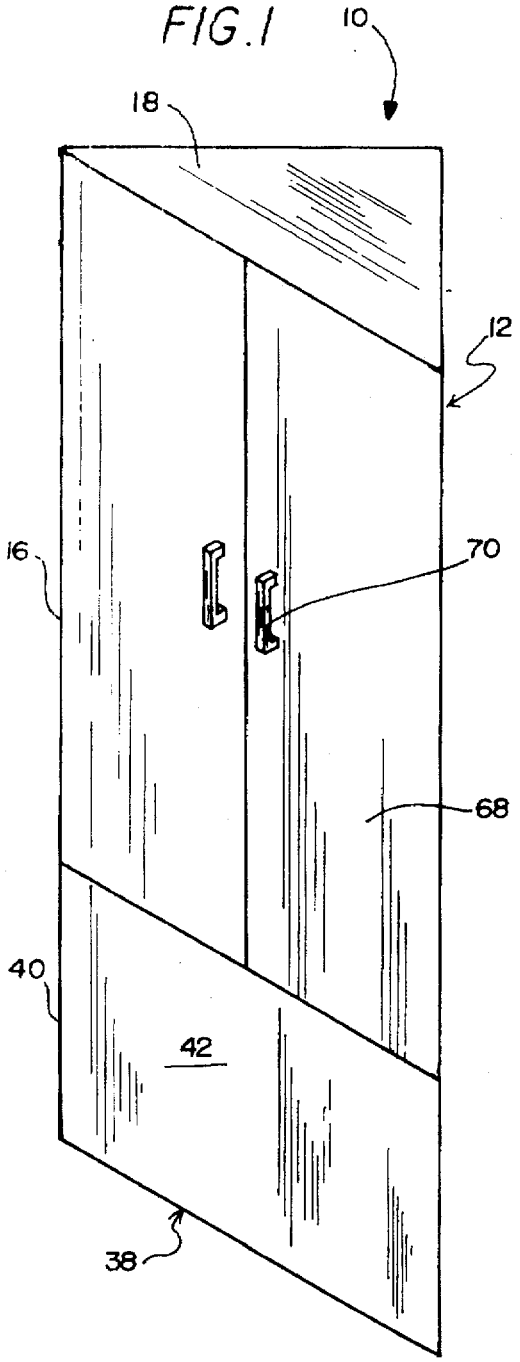
FIG. 1 is a perspective view of the preferred embodiment of the hair appliance storage cabinet constructed in accordance with the principles of the present invention.

With reference now to the drawings, and in particular to FIG. 1 thereof, the preferred embodiment of the new and improved hair appliance storage cabinet embodying the principles and concepts of the present invention and generally designated by the reference numeral 10 will be described.

The present invention, the hair appliance storage cabinet 10 is comprised of a plurality of components. Such components in their broadest context include a housing, a supporting base, a storage tube and a J-hook. Such components are individually configured and correlated with respect to each other so as to attain the desired objective.

Figure 2:
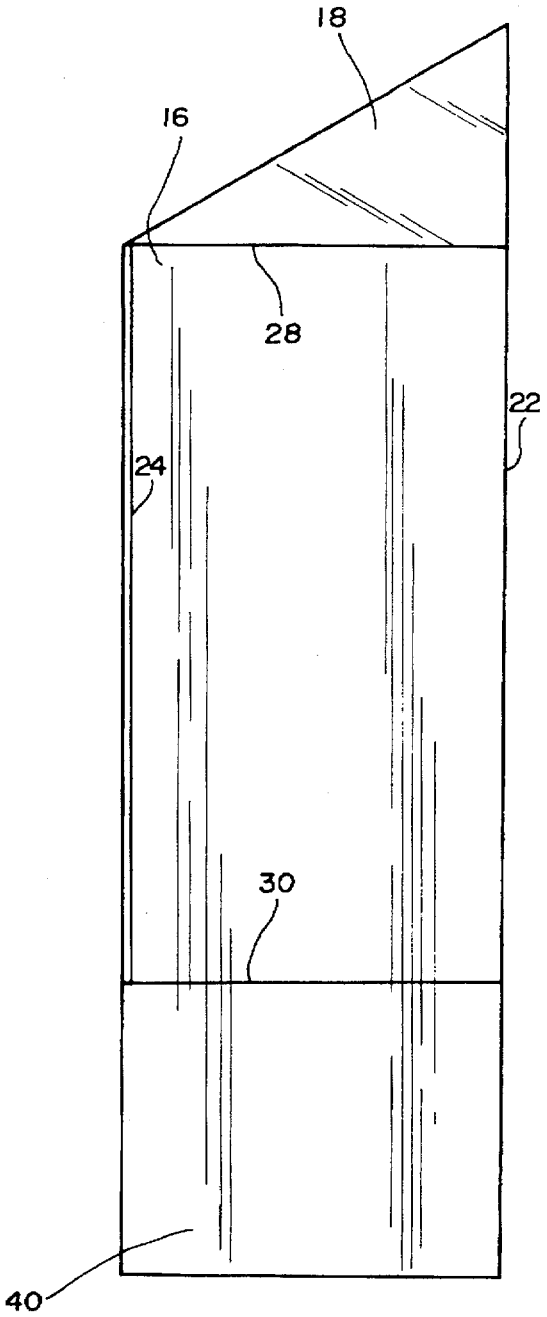
FIG. 2 is a side view of the present invention in an operable orientation.
Figure 3:
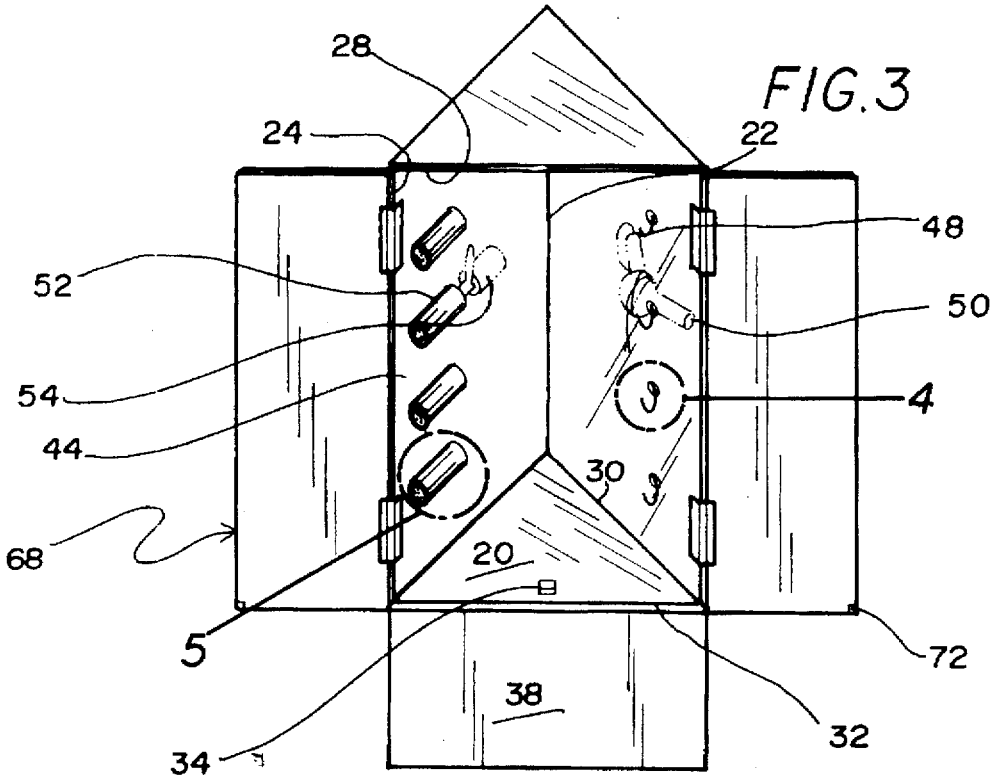
FIG. 3 is a frontal view of the present invention with the doors open to view the storage tube and J-hook members.

Specifically, the present invention includes a housing 12 that has a triangular form with a pair of upper side walls 16, a top wall 18 and a bottom wall 20. The housing may be formed of wood or plastic. The pair of upper side walls each have a first long end edge 22 and a second long end edge 24. As shown in FIG. 3, the first long end edge of each of the pair of upper side walls is fixedly attached and forms a ninety degree angle therebetween. The pair of upper side walls each have a first short end edge 28 and a second short end edge 30. The top wall, as seen in FIG. 2, is fixedly attached to each of the first short end edges. The top wall is attached when the pair of upper side walls have been attached together. The bottom wall is fixedly attached to each of the second short end edges when the pair of upper side walls are attached. The top wall and the bottom wall, when attached to the short end edges of the pair of upper side walls, form the housing. The bottom wall of the housing has a front end edge 32 and a door stop 34 adjacent the front end edge. The door stop, as shown in FIG. 3, is a magnetic door stop. The top wall and the bottom wall extend a small distance beyond the second long end edges of the upper side walls when each are attached to the pair of upper side walls.

As illustrated in FIG. 1, a supporting base 38 having a triangular form is provided. The supporting base has a pair of lower side walls 40 and a generally rectangular front panel 42. The front panel is flush with the front end edge of the bottom wall. The pair of lower side walls are fixedly attached to the bottom wall 20 of the housing. The pair of lower side walls, when attached to the bottom wall are flush with the upper side walls of the housing. The supporting base supports the housing above a receiving surface. The supporting base, with the housing positioned thereon, is positionable within a corner of a building.

Also, the pair of side walls 16 each have an interior surface 44 as shown in FIG. 3. The interior surface is accessible from exterior the housing when the housing 12 is seated on a supporting base 38. One of the upper side walls has a plurality of J-hook members 48 that are coupled to the interior surface, along a vertical alignment one to the other. Each J-hook member is capable of having a blow dryer 50 hung therefrom. Another of the upper side walls has a plurality of storage tubes 52 that are coupled to the interior surface along a vertical alignment one to the other. Each storage tube is open at opposite ends and is capable of receiving a portion of a curling iron 54 therein for supporting the curling iron. The curling iron enters into the storage tube at the end nearest the long end edge 22 of the applicable upper side wall.

Figure 4:
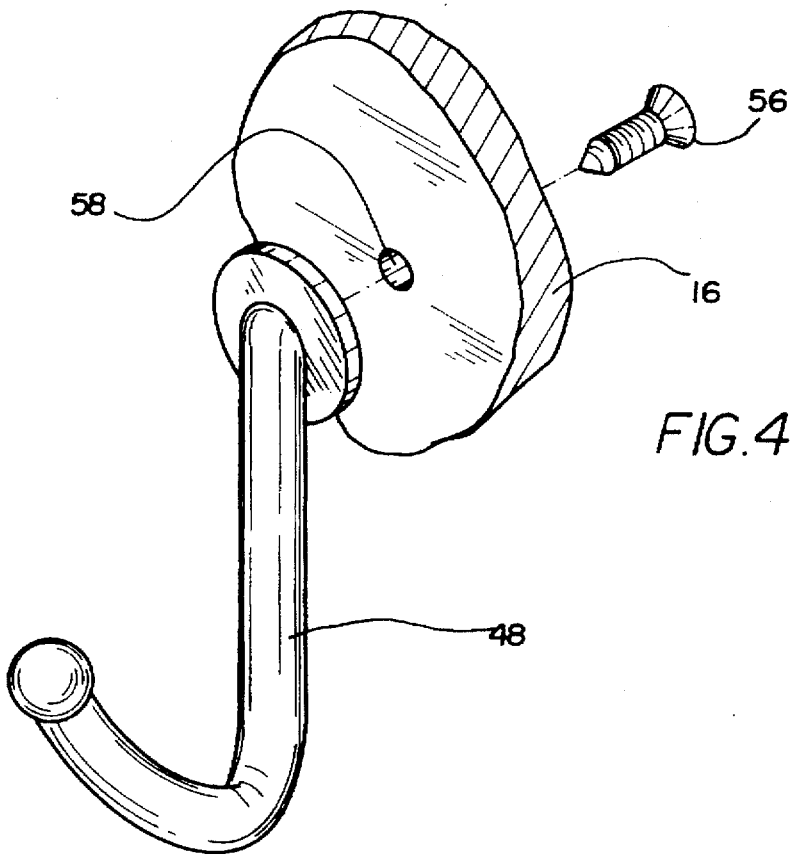
FIG. 4 is an enlarged sectional view of the coupling of the J-hook member taken along line 4 of FIG. 3.
Figure 5:
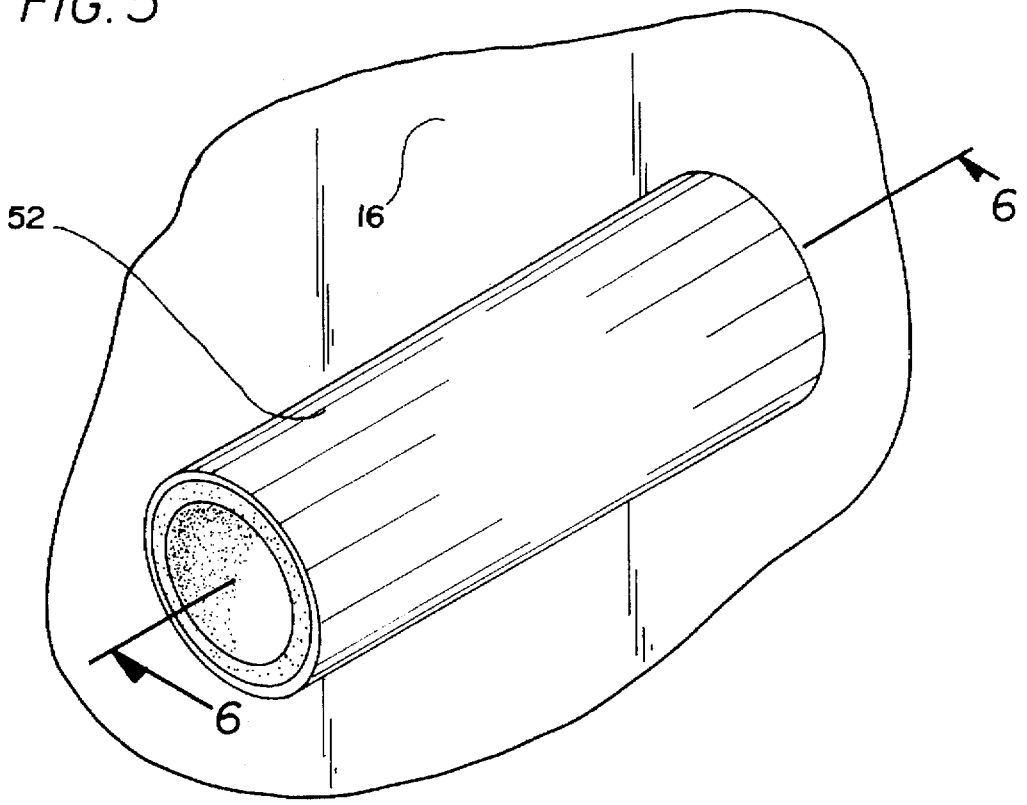
FIG. 5 is enlarged cut-away view of the storage tube taken at position 5 of FIG. 3.
Figure 6:
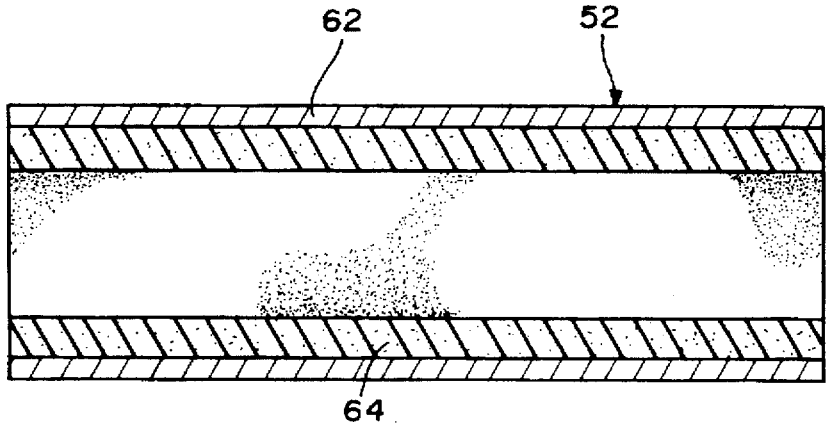
FIG. 6 is a cross-sectional view of the storage tube taken along line 6—6 of FIG. 5, The same reference numerals refer to the same parts through the various Figures.

Additionally, each J-hook, as depicted in FIG. 4, is coupled to the upper side wall by a screw 56. The screw passes through a hole 58 of the upper side wall into the J-hook member. Each storage tube is structured to prevent scratching of the portion of the curling iron placed within. Each storage tube has a metallic exterior 62 and a foam interior 64, as shown in FIG. 6. The foam interior provides suction that will hold the curling iron within the storage tube. The storage tube will come in a variety of sizes to accommodate the various sizes of curling irons available in today's market.

Lastly, a pair of generally rectangular door members 68 are included. Each door member has a handle 70 on the exterior of the door and a tab 72 on the interior of the door. Each door may be formed of wood, plastic, or glass. One of the door members is hingedly coupled to the second long end edge 24 of one of the upper side walls 1. Another of the door members is hingedly coupled to the second long end edge 24 of another of the upper side walls 16. Each tab of each door is positioned on the door so as to engage the door stop 34 of the bottom wall. The pair of door members are coupled the pair of upper side walls for selective opening and closing to allow access to the curling iron and blow dryer within the housing. The pair of door members when in the closed position, are held there by the coupling of the tabs and door stops. Each door, when closed, is positioned between the top wall and the bottom wall to be flush with the front panel of the bottom wall.

The present invention hair appliance storage cabinet is structured so as to fit in a corner. The storage cabinet of the present invention may come in a variety of sizes for positioning either on a floor in a standard type or positioned on a counter. Aligned from top to bottom on the interior surface of one of the upper side walls is a series of storage tubes into which the rod portion of the curling irons can be placed. On the interior surface of another of upper side walls is a series of J-hooks for hanging hair dryers. The hair appliance storage cabinet of the present invention provides a place to store a variety of hair utensils in a neat and orderly fashion. The present invention allows the cords of those electrical appliances to hang neatly and to remain untangled while stored in the cabinet.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved hair appliance storage cabinet for storing a plurality of electrical hair appliances comprising in combination:

a housing having a triangular form with a pair of upper side walls, a top wall and a bottom wall, the pair of upper side walls each having a first long end edge and a second long end edge, the first long end edge of each of the pair of upper side walls being fixedly attached forming a ninety degree angle therebetween, the pair of upper side walls each having a first short end edge and a second short end edge, the top wall being fixedly attached to each of the first short end edges when the pair of upper side walls being attached, the bottom wall being fixedly attached to each of the second short end edges when the pair of upper side walls being attached;

a supporting base having a triangular form with a pair of lower side walls and a generally rectangular front panel, the pair of lower side walls being fixedly attached to the bottom wall of the housing for supporting the housing above a receiving surface, the supporting base with the housing positioned thereon being positionable within a corner of a building;

the pair of upper side walls each having an interior surface being accessible from exterior the housing when the housing being seated on the supporting base, one of the upper side walls having a plurality of J-hook members being coupled to the interior surface thereof along a vertical alignment one to the other, each J-hook member being capable of having a blow dryer hung therefrom, the J-hook member being mounted to the one upper side wall with a screw;

the other of the upper side walls having a plurality of storage tubes coupled to the interior surface thereof and along a vertical alignment one to the other, each storage tube being capable of receiving a portion of a curling iron therein for supporting the curling iron, each storage tube having a metallic exterior and a foam interior, the foam interior providing a suction means for holding the curling iron therein; and a pair of generally rectangular door members with each door member having a handle, one of the door members being hingedly coupled to the second long end edge of one of the upper side walls, another of the door members being hingedly coupled to the second long end edge of the other of the upper side walls, the pair of door members being coupled to the pair of upper side walls for selective opening and closing to allow access to the curling iron and blow dryer within the housing.

* * * * *